US005974694A

United States Patent [19]

Vecchiola

[11] Patent Number: 5,974,694

[45] **Date of Patent: *Nov. 2, 1999**

[54] SHOE SOLE WITH CUSHIONING ELEMENT CAPABLE OF ENSURING FORCED AIR CIRCULATION IN THE INNER SECTION OF THE SHOE

[75] Inventor: Euro Vecchiola, Montegranaro, Italy

[73] Assignee: Finproject-S.p.A., Italy

[ * ] Notice: This patent issued on a continued prosecution application filed under 37 CFR 1.53(d), and is subject to the twenty year patent term provisions of 35 U.S.C. 154(a)(2).

[21] Appl. No.: 09/085,640

[22] Filed: May 27, 1998

[30] Foreign Application Priority Data

Jun. 13, 1997 [IT] Italy ..... MC97A0056

[51] Int. Cl.[6] ..... A43B 7/06

[52] U.S. Cl. ..... 36/3 B

[58] Field of Search ..... 36/3 B, 3 R

[56] References Cited

U.S. PATENT DOCUMENTS

| | | |
|---|---|---|
| 2,239,211 | 4/1941 | Wylie . |
| 4,617,745 | 10/1986 | Batra . |
| 4,654,982 | 4/1987 | Lee . |
| 4,860,463 | 8/1989 | Pin . |
| 4,939,851 | 7/1990 | Miller . |
| 5,655,314 | 8/1997 | Petracci . |

FOREIGN PATENT DOCUMENTS

| | | |
|---|---|---|
| 0 732 067 | 9/1996 | European Pat. Off. . |
| 78 06 330 U | 10/1978 | Germany . |
| WO 90 13233 | 11/1990 | WIPO . |
| WO 96 24267 | 8/1996 | WIPO . |
| WO 97 04676 | 2/1997 | WIPO . |

*Primary Examiner*—Ted Kavanaugh
*Attorney, Agent, or Firm*—Leonard Bloom

[57] ABSTRACT

This patent application concerns a molded plastic sole with pliable pumping cushion which, as the person wearing the same walks, forces air into the shoe and through an evacuation chamber with which the sole is fitted and which is connected to the exterior by one or more breather holes.

2 Claims, 1 Drawing Sheet

SHOE SOLE WITH CUSHIONING ELEMENT CAPABLE OF ENSURING FORCED AIR CIRCULATION IN THE INNER SECTION OF THE SHOE

This patent application concerns a moulded plastic sole which is provided on its upper surface with a pliable cushion which also ensures forced ventilation of the inner section of the shoe as a result of the alternating pressure of the user's foot on the same as he or she walks.

The sole in question is designed to ensure forced circulation of air in a closed shoe so that the foot can transpire properly. It is common knowledge that in conventional closed shoes with plastic sole the foot does not transpire properly with the risk of skin irritation and peeling; this becomes even more of a problem for those who tend to sweat heavily.

As a matter of fact this problem has already been faced with techniques which are undoubtedly more sophisticated and costly, the most common of which require radical modification to the structure of the rubber sole itself.

The soles which to date ventilate the foot generally have a hollow at the front of the sole designed to house a conforming insert which pumps air as well as a chamber through which the air drawn into the shoe is evacuated, generally on the heel; it being provided that these two hollows intercommunicate by means of a series of longitudinal air passages in the sole at approximately the level of the shank.

The air drawn into the shoe by the opposing pumping insert is then conveyed into the longitudinal air ducts and from these flows into the chamber positioned on the heel from which it is evacuated to the exterior of the shoe through one or more breather holes opening on the sides of the heel.

As far as the pumping element is concerned, it should be noted that to date on the most commonly used models the same is realised in rather soft materials and is fitted with a closely fitted series of pliable hollow fingers each of which is provided with a respective hole through which air is drawn into the inner section of the shoe.

The energetic pressure placed on these fingers by the sole of the foot due to the impact of the shoe on the treading surface compresses the same thereby forcing the air out into the longitudinal air passages which in turn convey the air to the evacuation chamber.

It is evident that each finger of the above pumping insert elastically resumes its shape as soon as the foot lifts from the ground; obviously this expansion again forces air into each hollow finger which is again forced out as described above when the shoe is again pressed against the treading surface.

The sole according to the invention is a valid alternative to this tried and tested technique in that it provides the same practical result with a less sophisticated and consequently less costly structure which is easier to produce.

In particular the item according to the invention supercedes the prior manufacturing principle requiring two separate hollows (at the front to house the pumping insert and at the back for the evacuation of air) joined and connected by one or more straight longitudinal air passages between the same.

In order to implement the inventive solution a single long cavity is provided on the upper surface of a plastic moulded sole; this cavity extends from the middle of the front section to the heel including the shank area without any gaps.

For most of its length from the front end, said cavity houses an innovative conforming pumping insert; while the rear section of the cavity, namely that on the heel, acts as evacuation chamber.

For this reason the rear section of the cavity in question is connected to the exterior by one or more breather holes realised in the preferred embodiment on the front vertical edge of the heel.

In this regard, the innovative pumping insert consists of a pliable and elastic plastic cushion provided in the interior with a series of rectilinear ducts each of which communicates with the exterior by means of a series of holes realised on the upper surface of the cushion.

As mentioned previously, said cushion is housed in the long section of the above cavity which covers the front area of the sole and shank; it being provided in particular that the inner ducts are positioned parallel to the longitudinal axis of the sole.

Moreover, the cushion is shaped and dimensioned to fit perfectly with a slight pressure into the section of the cavity in question; this perfect fit prevents unwanted sliding of the cushion in the respective housing and consequently ensures absolute stability in the sole according to the invention.

The ducts provided in the cushion in question produce a pumping action which in the conventional models was produced by the yielding fingers.

When the cushion housed in the sole according to the invention is pressed by the weight of the foot, the air in the inner ducts is forced out and when the sole is lifted from the treading surface the inner ducts spontaneously resume their original shape and are again filled with air through the series of holes provided therefor.

In this regard it should be noted that the air in the inner ducts of the pumping insert in question can escape only through the rear section of the cavity, which is the only cavity not occupied by the cushion.

For the remaining perimeter in fact of the pumping insert the ends of the ducts are "sealed" by the vertical walls of the housing which prevents air from escaping and consequent loss of pressure.

This means that the air expelled from the cushion, thanks also to the longitudinal positioning of its inner ducts, can only be forced into the evacuation chamber provided on the heel of the sole according to the invention.

In this sense it is obvious that the longitudinal ducts of the pumping cushion fitted on the sole according to the invention replace, in terms of positioning and function, the rectilinear ducts which in conventional soles link the front housing section and the rear air evacuation chamber.

It should also be noted that the pumping cushion used in the sole according to the invention ensures an undoubtedly more efficient and regular air flow with respect to that produced by the pumping inserts of the previous type, namely those using the conventional fingers positioned side by side; the reason for this is that the rectilinear ducts used have no dividing or deviating sections which would certainly result in a loss of load capable of preventing the free circulation of air.

For major clarity the description according to the invention continues with reference to the enclosed drawings which are intended for purposes of illustration and not in a limiting sense whereby:

Figure 2:
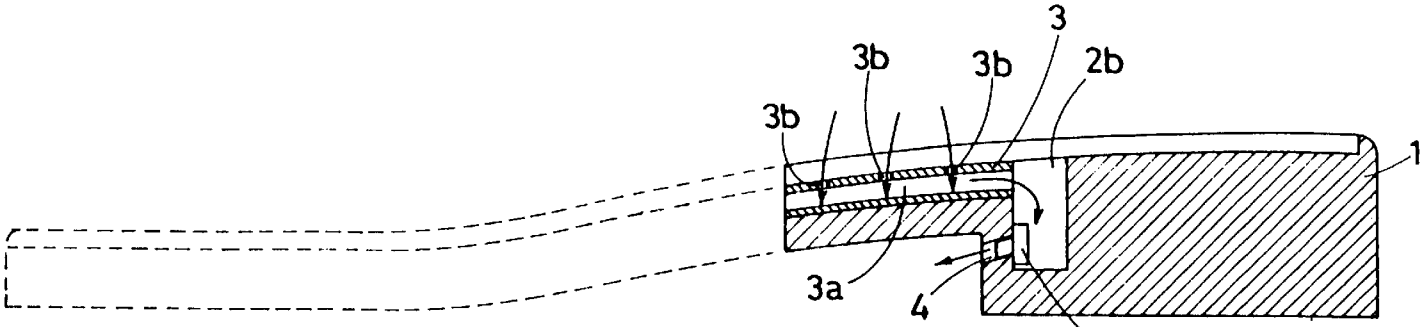
FIG. 2 is a cross-section of FIG. 1 on plane II—II.
Figure 1:
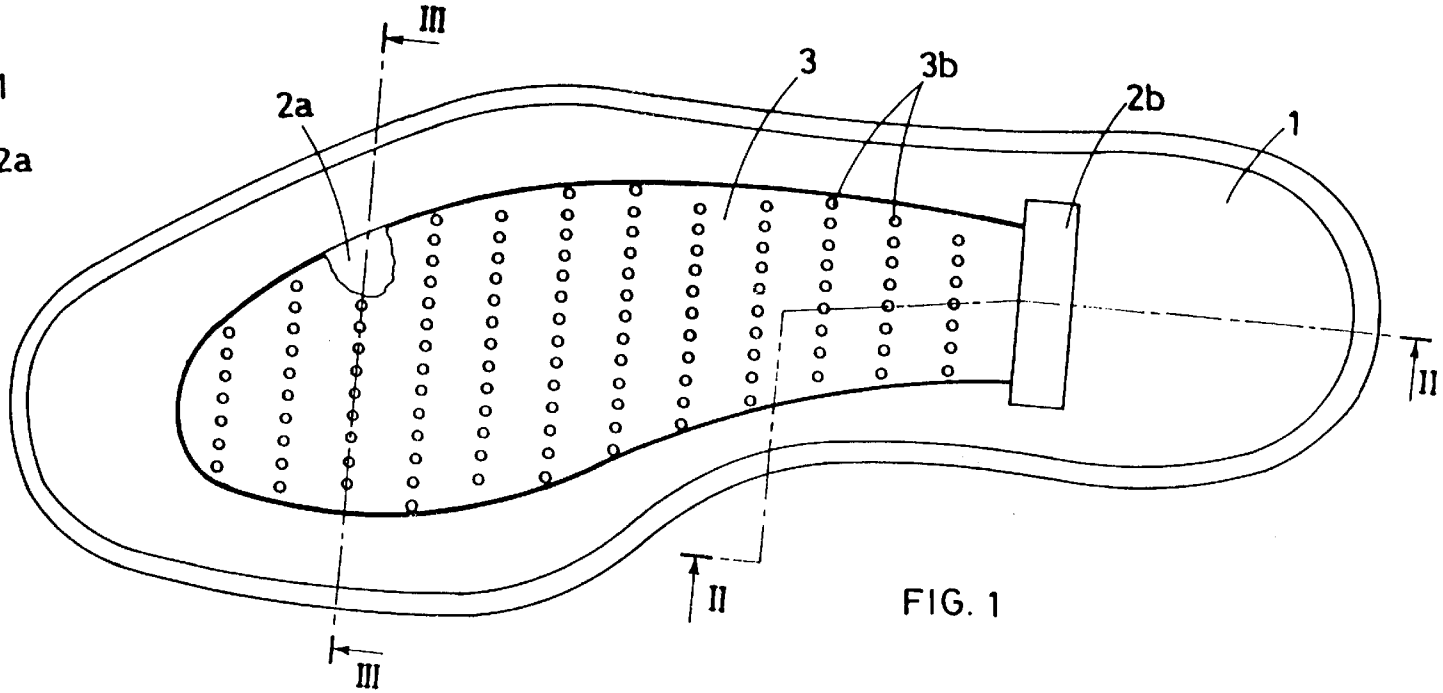
FIG. 1 is a top view of the sole according to the invention.
Figure 3:
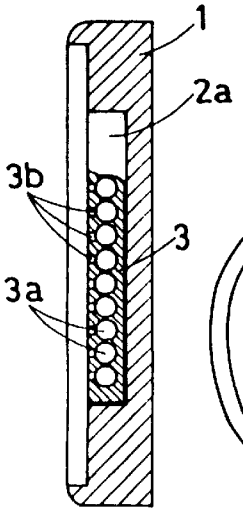
FIG. 3 is a cross-section of FIG. 1 on plane III—III.

With reference to the enclosed figures, the sole according to the invention (1) is moulded in plastic material and provided with a long cavity on its upper surface which extends continuously from the front section to the heel; the first long section (2*a*) of said cavity—namely that on the front section and on the shank—is designed to house a special conforming pumping insert (3).

The rear section (2*b*) of the same cavity—namely that positioned approximately on the heel area—remains empty and is the air evacuation chamber which communicates with the exterior thanks to a small breather hole (4) under the sole (1) on the front vertical wall of the heel.

It should be noted that a unidirectional valve 5 to prevent air, dust or water from the exterior from entering in the evacuation chamber (2*b*) could be fitted on said breather hole (4).

Regarding the pumping insert (3), the same consists of a pliable elastic plastic cushion provided internally with a series of rectilinear ducts (3*a*) positioned parallel to the longitudinal axis of the sole (1); the upper surface of the cushion (3) being provided with a series of holes (3*b*) designed to link the above inner ducts (3*a*) to the exterior.

As mentioned above, the particular positioning of the ducts (3*a*) of the pumping insert (3), parallel to the longitudinal axis of the sole (1) ensures that every time the pumping insert (3) is pressed—the air in the same flows directly into the empty rear section (2*b*) of the above cavity, namely the section which acts as the evacuation chamber.

It should be mentioned that shoes fitted with the sole according to the invention must be provided internally with a hygienic inner sole having numerous through holes preferably coinciding with the position of the holes (3*b*) which allow air to enter the pumping insert (3).

This feature is designed to prevent the inner sole from sealing the upper surface of the underlying pumping insert (3) thereby preventing the air in the shoe section from being drawn into the same.

I claim:

1. A molded shoe sole having a longitudinal axis, a top surface, an opposite bottom surface and a heel at an end thereof, comprising:

an elongated cavity being formed in the top surface, the cavity having a first front section extending continuously forwardly from the heel communicating with an empty second back section disposed over the heel and extending downwardly into the heel, the second back section being uninterrupted and continuous with the first front section, a pliable elastic cushion being disposed in the cavity, the cushion having an upper surface and a length, the cushion serving as a pump, a plurality of internal rectilinear ducts being formed in the length of the cushion parallel to the longitudinal axis of the sole, the ducts communicating with the second back section of the cavity, a series of spaced-apart holes being formed in the upper surface of the cushion and extending to the internal ducts within the cushion, such that air exteriorly of the sole may be pumped into the ducts through the holes over the length of the cushion, at least one breather hole formed in the heel communicating with the second back section of the cavity, the breather hole extending exteriorly of the heel, wherein walking on the shoe sole forces air out of the internal ducts, into the second back section and outward through the at least one breather hole and lifting the shoe sole draws air through the spaced-apart holes into the ducts.

2. The molded shoe sole of claim 1, further comprising a respective unidirectional valve disposed in the at least one breather hole.

* * * * *